United States Patent [19]

Poe

[11] 4,155,575

[45] May 22, 1979

[54] ROTARY LATCH WITH AUTOMATIC ADJUSTMENT MEANS

[75] Inventor: L. Richard Poe, Long Beach, Calif.

[73] Assignee: Hartwell Corporation, Placentia, Calif.

[21] Appl. No.: 854,660

[22] Filed: Nov. 25, 1977

[51] Int. Cl.[2] ..... E05C 19/18

[52] U.S. Cl. ..... 292/190; 24/205.17

[58] Field of Search ..... 292/54, 190, 202, 210, 292/218, 256, 256.6, 300; 24/205.17, 238

[56] References Cited

U.S. PATENT DOCUMENTS

| | | | |
|---|---|---|---|
| 617,582 | 1/1899 | Kuhn | 292/190 X |
| 767,677 | 8/1904 | Ashley | 292/190 |
| 2,832,120 | 4/1958 | Jayet | 24/205.17 |

FOREIGN PATENT DOCUMENTS

| | | | |
|---|---|---|---|
| 727600 | 11/1942 | Fed. Rep. of Germany | 24/205.17 |
| 10488 of | 1891 | United Kingdom | 292/190 |

*Primary Examiner*—J. Franklin Foss

*Attorney, Agent, or Firm*—Lyon & Lyon

[57] ABSTRACT

A rotary latch including a manually rotatable drive means having a semi-circular hooked shaped latch arm increasing in radial width to compensate for the position of a keeper when engaged thereby, the drive means fitted with an axially movable shaft having a splined surface, engagable with a fixed splined surface to lock the latch arm in engagement with the keeper in such a manner as to eliminate free play; the shaft having an inner position to permit engagement with the drive member, a position flush with the drive member when the latch arm and keeper are interlocked and an extended signal position when the latch arm and keeper are disengaged.

10 Claims, 14 Drawing Figures

ROTARY LATCH WITH AUTOMATIC ADJUSTMENT MEANS

BACKGROUND

A disadvantage with most rotatable latches, particularly such latches used on aircraft, is that the eye bolt keeper must be adjusted by trial and error while the latch is disengaged therefrom in order to minimize or eliminate any freeplay.

SUMMARY

The present invention is directed to a rotary latch with automatic adjustment means to eliminate freeplay between a rotary hook latch and its keeper, and is summarized in the following objects:

First, to provide an automatic adjustment means for rotary latches of the type having an arcuate latch element of increasing radial width engageable with a keeper element, the rotary latch including novelly arranged fixed and movable spline elements capable of relative rotary movement as the latch element enters the keeper element for mutual engagement, the spline elements thereupon being relatively movable axially causing interengagement of the spline elements to lock the latch element and keeper element in corresponding mutual engagement eliminating free play.

Second, to provide an automatic adjustment means for rotary latches, as indicated in the preceding object, which is particularly adapted as a flush type latch for aircraft which is so arranged as to utilize a simple hand tool in the form of a polygonal rod to force the spline elements out of mutual engagement thereby to effect movement of the rotary latch.

Third, to provide an automatic adjustment means, as indicated in the other objects, which, in one embodiment a central shaft includes a flange carrying movable axially extending spline elements and a surrounding housing bore having fixed spline elements and in a second embodiment in which the spline elements are in axially confronting relation, in both embodiments the central shaft is movable axially between a recessed position when the spline elements are disengaged to permit movement of the rotary latch, a flush position in which the latch elements are interengaged to secure the latch element and keeper element against freeplay and the spline elements are in an extended position to indicate that the latch element is free of the keeper element.

BRIEF DESCRIPTION OF THE FIGURES

FIGS. 1 through 7 illustrate one embodiment the rotary latch with automatic adjustment means, in which:

FIG. 1 is an elevational view showing the outer side of the rotary latch with automatic adjustment means shown attached to a keeper.

FIG. 2 is a similar view with the housing cover member removed.

FIG. 3 is a longitudinal sectional view thereof taken through 3—3 of FIG. 1 showing the latch arm and the keeper in mutual engagement and the automatic adjustment means in its interlocked position.

FIG. 4 is a similar sectional view, with portions in elevation, showing the adjustment means disengaged, and a turning tool in position to operate the latch.

FIG. 5 is a similar sectional view, with portions in elevation, showing the adjustment means as it appears when the latch arm and keeper are disengaged with an end of the adjustment means protruding for observation.

FIG. 6 is a transverse sectional view taken through 6—6 of FIG. 3.

FIG. 7 is an enlarged transfer sectional view taken through 6—6 of FIG. 3 showing the adjustment means.

FIGS. 8 through 14 illustrate another embodiment of the rotary latch with automatic adjustment means in which:

FIG. 8 is an elevational view similar to FIG. 2, with the housing cover member removed.

FIG. 9 is a longitudinal sectional view thereof taken through 9—9 of FIG. 8 showing the latch arm and the keeper in mutual engagement and the automatic adjustment means in its interlocked position.

FIG. 10 is a similar sectional view, with positions in elevation, showing the adjustment disengaged, and a turning tool in position to operate the latch.

FIG. 11 is another similar sectional view, with positions in elevation, showing the latch when the latch arm and keeper are disengaged with an end of the adjustment means protruding for observation.

FIG. 12 is a bottom view of the latch member.

FIGS. 13 and 14 are transverse sectional views taken through 13—13 and 14—14 of FIG. 9.

DETAILED DESCRIPTION

Figure 7:
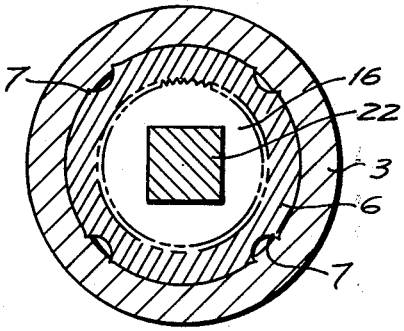

The rotary latch with automatic adjustment means includes an housing having an inner or base member 1 which includes a base plate 2 having a tubular inwardly or downwardly directed extension 3 closed at its extremity. Formed in the wall of the tubular extension is a semi-circular slot 4 having an axially outwardly extending end 5. Received in the tubular extension 3 outwardly of the axially extending end 5 of the slot 4 is an internally splined sleeve 6. The sleeve also includes external splines 7 which engage the inner surface of the tubular extension 3 to lock the sleeve 6 relative to the extension as shown particularly in FIG. 7.

The base plate 2 receives a housing cover 8 secured to the base plate 2 by rivets 9. Formed in the housing cover 8 and confronting the base plate 2 is a latch disk cavity 10. The housing cover member 8 is provided with an annular boss 11 having a central bore **11*a* which aligns with the tubular extension 3. The two housing members are provided with a radial keeper receiving slot 12**.

Received in the cavity 10 and the attached end of the tubular extension 3 is a latch member 13. The latch member includes a latch disk 14 fitted in the cavity 10, an outwardly extending sleeve 15 received in the central bore 11 and an inwardly extending boss 16 disposed between the disk cavity 10 and splined sleeve 6. The latch disk 14 is provided with an arcuate clearance slot 17 occupying approximately 180°. The slot is defined by a semi-circular latch arm 18. The peripherally extended end of the arm forms with the adjacent portion of the latch disk 14 a radial slot 19 to provide entrance to the clearance slot 17. The radial width of the arm 18 increases from its tip end at the slot 19 toward its base end attached to the remainder of the latch disk 14. That is, the radial distance decreases from the slot 19. The latch disk is capable of rotation from a position in which the radial slot 19 aligns with the keeper receiving slot 12 as indicated by dotted lines in FIG. 2 to a position in which opposite end of the latch arm approaches the keeper receiving slot 12.

Figure 1:
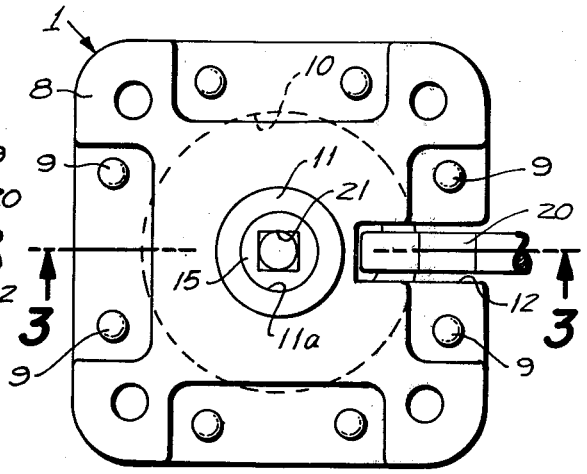

A conventional loop type keeper 20 is provided which is arranged to be mounted by means not shown in position for radial movement in the keeper receiving slot 12. Due to the decreasing radius of the radially inner surface of the latch arm 18, rotation of the latch arm draws the keeper loop 20 radially inward until slack or play between the arm and the keeper is essentially zero, this position being represented in FIGS. 1, 2 and 3.

The latch member 13 is provided with a central bore 21 which is polygonal in cross section, preferably square. The bore 21 receives a shaft 22 of corresponding polygonal cross section so that the shaft 22 turns with the latch member 13 but is capable of relative axial movement. The shaft 22 is provided with a circular flange 23 having external locking splines. The shaft 22 extends inwardly from the flange 23 and receives a cross pin 24, one end of which is received in the slot 4 and its axial extension 5, different positions of the cross pin 24 being shown in FIGS. 3, 4 and 5. A disk 25 and a spring 26 underlie the cross pin, the spring bearing against the closed end of the tubular extension 3. The spring urges the shaft in a direction to cause interengagement between the splined flange 23 and the splined sleeve 6.

Figure 2:
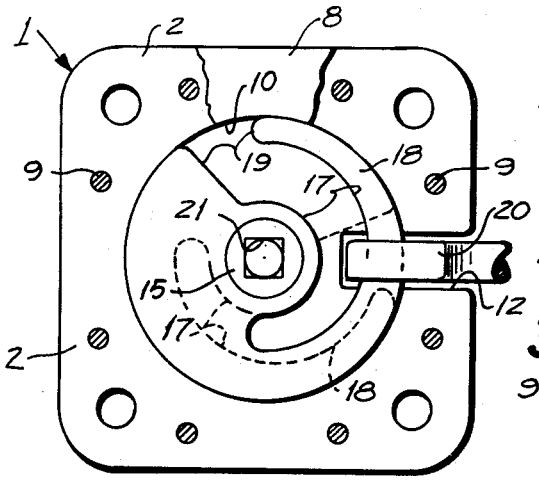
Figure 4:
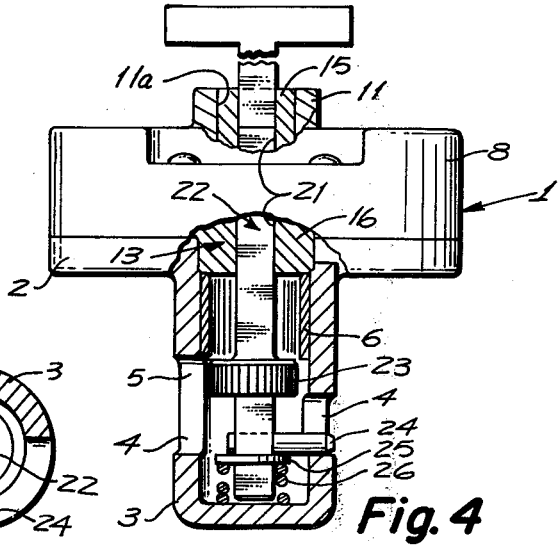
Figure 5:
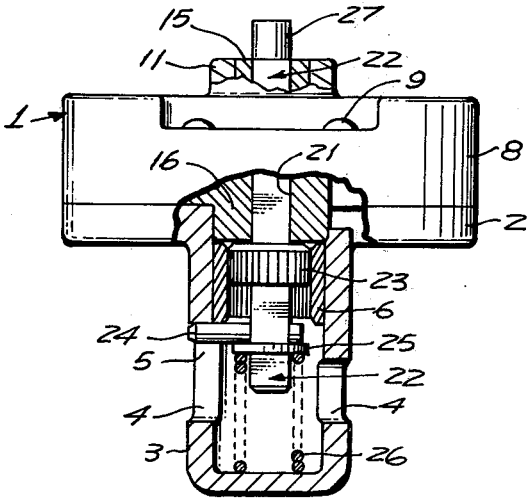

Operation of the rotary latch with automatic adjustment means shown in FIGS. 1 through 7 is as follows:

When the latch is in the dotted line position shown in FIG. 2, the pin 24 is in the position shown in FIG. 5, that is, the pin is received in the axially extended end 5 under urge of spring 26, the shaft 22 protrudes, and the splined disk 25 and splined sleeve 6 are in engagement holding the latch arm 18 in position to receive the keeper loop 20. Upon insertion of the keeper loop in the slot 12, a turning tool T having a cross section corresponding to the shaft 22 is pressed against the exposed end of the shaft, depressing the shaft 22 as shown in FIG. 4 so as to provide a drive connection with the latch member 13, and the splined flange 23 disengaged from the splined sleeve 6.

Figure 3:
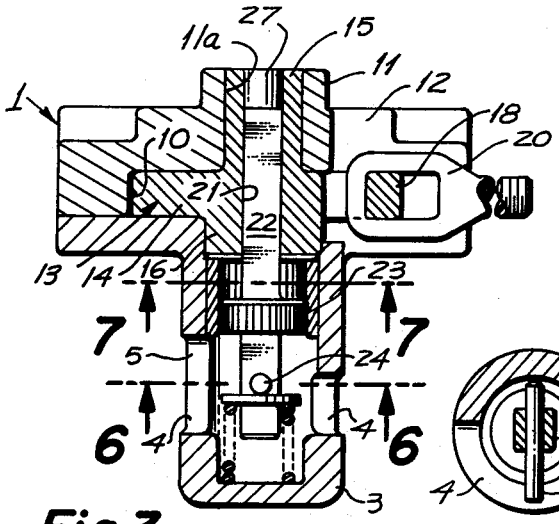
Figure 6:
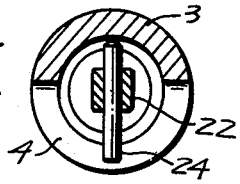

The turning tool is then used to turn the latch member 13 causing the latch arm 18 to move counterclockwise from the dotted line position shown in FIG. 2 toward the solid line position shown therein. In doing so, the keeper loop is drawn radially inward until essentially all slack or play is eliminated, that is, the arm 18 is turned as far as permitted by the keeper loop 20. Thus, the position of the latch arm 18 may vary. When the tool has turned the latch arm 18 as far as possible, the tool T is removed, permitting the spring 26 to force the splined flange 23 into the splined sleeve 6 as shown in FIG. 3.

When it is desired to disconnect the rotary latch from the keeper, the turning tool T is caused to depress the shaft 22 as shown in FIG. 4 whereupon the latch arm 18 may be turned to the position indicated by dotted lines in FIG. 2. As this extreme position of the arm positions the cross pin 24 in registry with the axially extended end 5 of the slot 4. Removal of the turning tool permits the shaft 22 to extend as shown in FIG. 5. Such extension is utilized to provide a visual signal as indicated by 27 that the latch is not engaged. It should be noted that the protruding end of the shaft 22 is cylindrical and may be brightly colored. Also, being cylindrical deters the use of a clamping tool in place of the tool T.

The rotary latch is intended to be mounted so that the outer ends of the housing cover boss 11, and outwardly extending sleeve 15, are flush with the surface of the door or panel structure in which the rotary latch is mounted. While the rotary latch is intended primarily for installation on aircraft, it is not limited thereto.

Referring to FIGS. 8 through 14, the embodiment here illustrated is in most respects similar to the first embodiment as indicated by similar reference numerals. In place of an axially directed spline sleeve 6, and spline flange 23, the inward face of the boss 16 is provided with radial splines 28, and an axially slidable collar 29 is provided with radial splines 30 engagable with the splines 28. In the embodiment the portion of the shaft 22 below the latch member 13 is circular to permit relative rotation of the collar 29.

The collar 29 is provided with a radiating pin 31 which rides in a longitudinal slot 32 provided in the sleeve 3 in place of the slot 4 and extension 5.

The collar 29 has an axial slot 33 which slidably receives a radiating pin 34 secured in the shaft 22. Inward from the pin 34 is a cross pin 35 secured in the shaft 22. Underlying the pin 35 is a disk 36. A spring 37 is disposed between the disk 36 and the extended closed end of the tubular extension.

To limit the travel of the latch member 13, the disk 14 and a portion of the arm 18 is provided with a semicircular marginal groove 38 at the underside and the base member 2 is provided with an upwardly extending pin 39.

Figure 8:
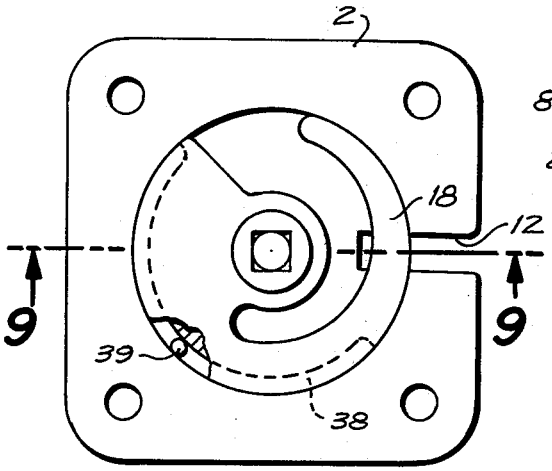
Figure 9:
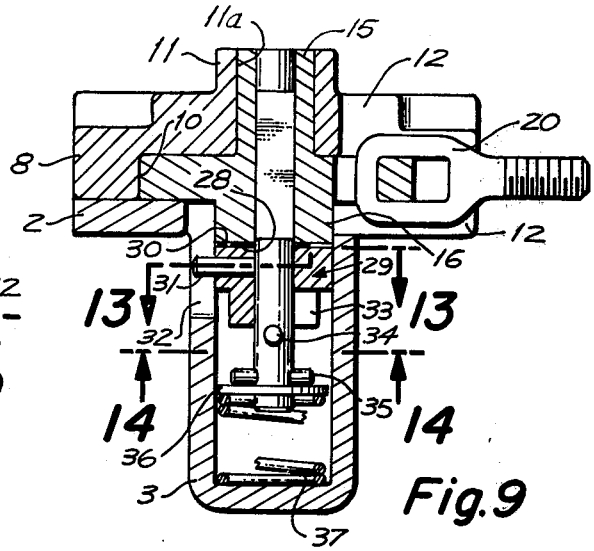
Figure 12:
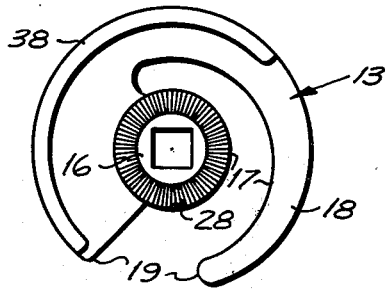
Figure 10:
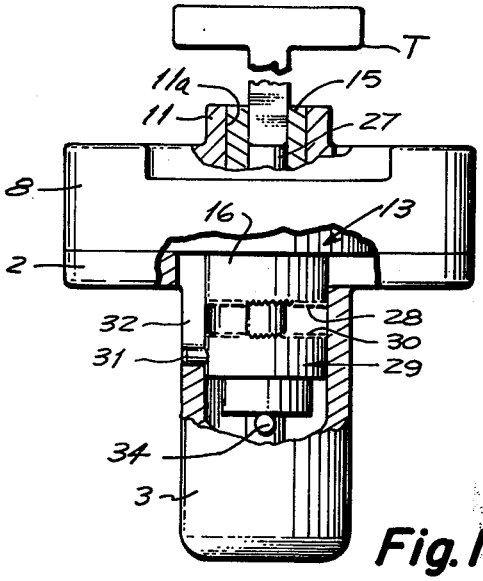
Figure 13:
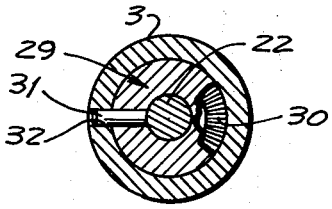
Figure 14:
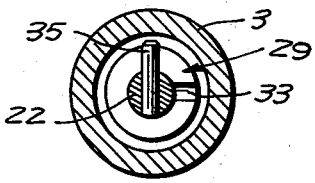

Operation of the embodiment shown in FIG. 8 is as follows:

When the tool T is inserted in the central bore 21 depressing the shaft 22, as shown in FIG. 10, and turned to engage the keeper, the tapered latch arm 18 draws the keeper radially inward until free movement of the keeper is eliminated. During this movement of the depressed shaft 22 the radial splines 28 and 30 are disengaged. When the shaft and latch arm are turned to the extent permitted by the keeper, the tool T is withdrawn permitting the spring 37 to force the splines 30 into engagement with the splines 28, as shown in FIG. 10 locking the latch in its secured condition shown in FIG. 9 with the outer end in flush relation with the surrounding surface.

Figure 11:
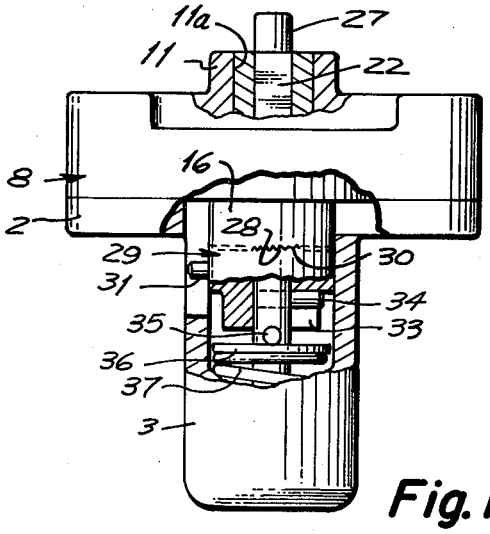

When the tool T turns the latch arm 18 clear of the keeper 20, the pin 34 aligns with the slot 33 permitting the round end 27 of the shaft 22 to protrude as shown in FIG. 11 and warn that the latch is disconnected.

Having fully described my invention, it is to be understood that I am not to be limited to the details herein set forth, but that my invention is of the full scope of the appended claims.

I claim:

1. A rotary latch structure for engagement with a keeper loop, the latch structure comprising:

a. a fixed housing having a journal bore intersected by a radially enlarged chamber, the chamber being intersected by a keeper access slot at one side;

b. a latch means, journalled in the journal bore and including a semi-circular latch arm having a radially inner side defining with respect to the axes of rotation of the latch an eccentric surface, whereby on rotation of the latch means, the keeper loop is drawn radially toward the axis of the latch means until any slack in the connection is essentially eliminated and further relative movement of the latch arm and keeper loop is terminated;

c. an axially movable shaft is carried by the latch means;

d. the shaft being adapted to occupy a third position in which the shaft visibly protrudes, the shaft being movable to said third position when the latch arm and keeper loop are disengaged, thereby to provide warning of such disengagement.

e. and multiple position mutually engaging means operable upon axial movement of the shaft, to secure the latch arm and keeper loop in said movement terminated position.

2. A rotary latch structure, as defined in claim 1, wherein:

a. the shaft is adopted to occupy a third position in which the shaft visibly protrudes, the shaft being movable to said third position when the latch arm and keeper loop are disengaged, thereby to provide warning of such disengagement.

3. A rotary latch structure, as defined in claim 1, wherein:

a. the mutually engaging means includes a fixed internally splined sleeve camed by the housing, and a movable externally splined flange camed by the shaft.

4. A rotary latch structure, as defined in claim 1, wherein:

a. the mutually engaging means includes a first splined radial surface carried by the latch means, and a second splined radial surface carried by the shaft.

5. A slack compensating latch structure adapted for engagement with a keeper loop, the latch structure comprising:

a. a fixed housing;

b. a latch unit carried by the housing, the latch unit including a latch arm movable with respect to the housing and the keeper loop until the slack between the latch unit and keeper loop is minimized;

c. a rotatably fixed multiple position locking means;

d. rotatable multiple position locking means;

e. the rotatable locking means capable of movement in correspondence to movement of the latch arm until slack is minimized between the latch arm and keeper loop, whereupon the rotatable locking means is engagable with the rotatably fixed locking means to secure the latch arm and keeper loop in said slack minimized position.

6. A latch structure, as defined in claim 5, wherein:

a. the latch arm is essentially semi-circular presenting an eccentric radially inner surface;

b. said rotatably fixed locking means is tubular;

c. said totatable locking means is circular and movable axially into locking engagement with the first locking means.

7. A latch structure, as defined in claim 5, wherein:

a. said rotatably fixed locking means and rotatable present confronting parallel surfaces having radiating plines.

8. A latch structure as defined in claim 5, wherein:

a. the latch unit includes a central portion journalled in the housing and includes a polygonal central bore;

b. an axially movable shaft is received in the central bore and carries the second locking means;

c. the shaft being axially depressible in the central bore permitting insertion of a turning tool and simultaneous disengagement of the first and second locking means;

d. the shaft being axially extensible when the latch arm and keeper loop are disengaged to indicate such disengagement.

9. A rotary latch structure adapted for engagement with a keeper loop, the latch structure comprising:

a. a fixed housing having a journal bore intersected by a radially enlarged chamber, the chamber being intersected by a keeper access slot at one side;

b. a latch unit journalled in the journal bore and including a flange received in the chamber, the flange having a semi-circular slot and a semi-circular latch arm bordering the slot, the latch arm having an extended end adapted to receive a keeper loop and a supported end joined to the flange, the radially inner surface of the latch arm being progressively reduced in diameter whereby the latch arm draws the keeper loop radially inward until the keeper loop resists further movement;

c. the latch unit having a central polygonal bore;

d. the housing having an extension of its journal bore;

e. a polygonal shaft received in the latch unit bore and protruding into the journal bore extension;

f. a multisplined sleeve secured in the journal bore extension;

g. a multisplined flange carried by the shaft for engagement with splined sleeve, the shaft having a lower position exposing the upper end of the latch unit and placing the flange clear of the splined sleeve, whereby a tool may be received in the upper end of the latch unit for rotating the latch arm;

h. the shaft also having a mid-position wherein the multislined sleeve and flange are in mutual engagement; and an upwardly extended position, the positions of the shaft being determined by a lateral pin extending from the shaft and a slot formed in the housing extension to receive an end of the pin.

10. A rotary latch structure adapted for engagement with a keeper loop, the latch structure comprising:

a. a fixed housing having a journal bore intersected by a radially enlarged chamber, the chamber being intersected by a keeper access slot at one side;

b. a latch unit journalled in the journal bore and including a flange received in the chamber, the flange having a semi-circular slot and a semi-circular latch arm bordering the slot, the latch arm having an extended end adapted to receive a keeper loop and a supported end joined to the flange, the radially inner surface of the latch arm being progressively reduced in diameter whereby the latch arm draws the keeper loop radially inward until the keeper loop resists further movement;

c. the latch unit having a central polygonal bore;

d. the housing having an extension of its journal bore;

e. a shaft having a polygonal position forming a driving connection with the polygonal bore of the latch unit;

f. a collar slidable on the shaft within the journal bore extension, the collar being restrained against rotation;

g. the collar confronting the central portion of the latch unit flange to form parallel surfaces;

h. said surfaces including intermeshing radial splines;

i. the shaft and collar having a lower position in which the splines are disengaged and the upper end of the polygonal bore is exposed to receive a turning tool, an intermediate position where the splines are interengaged in which the upper end of the shaft is flush with the upper end of the latch unit, and an upper position when the latch arm and keeper are disengaged in which the upper end position of the shaft protrudes to indicate such disengagement.

* * * * *